United States Patent [19]

Cleemann

[11] Patent Number: 4,598,873

[45] Date of Patent: Jul. 8, 1986

[54] METHOD OF MANUFACTURING A PUMPABLE COAL/LIQUID MIXTURE

[75] Inventor: Jørgen Cleemann, Copenhagen, Denmark

[73] Assignee: F. L. Smidth & Co. A/S, Denmark

[21] Appl. No.: 499,855

[22] Filed: Jun. 1, 1983

[30] Foreign Application Priority Data

Jun. 14, 1982 [GB] United Kingdom ..... 8217170

[51] Int. Cl.[4] ..... B02C 19/12

[52] U.S. Cl. ..... 241/21; 241/24; 241/29; 241/101 B

[58] Field of Search ..... 241/29, 21, 24, 81, 241/101 B, 117–122, 152 A, 184; 44/51

[56] References Cited

U.S. PATENT DOCUMENTS

| | | | |
|---|---|---|---|
| 2,826,370 | 3/1958 | Weston | 241/81 X |
| 3,497,142 | 2/1970 | Nelson | 241/29 X |
| 3,773,268 | 11/1973 | Bond | 241/284 X |
| 4,132,365 | 1/1979 | Verschuur | 241/21 |
| 4,265,407 | 5/1981 | Kessler et al. | 241/101 B X |
| 4,282,006 | 8/1981 | Funk | 44/51 |

FOREIGN PATENT DOCUMENTS 50412 4/1982 European Pat. Off. .

OTHER PUBLICATIONS

"Development and Evaluation of Highly-Loaded Coal Slurries", R. S. Scheffee and E. T. McHale, 2nd International Symposium on Coal-Oil-Mixture Combustion, Nov. 27–29, 1979, Danvers, Mass., U.S.A.

"Herstellung, Transport und Verbrennung von Kohle/-Wasser-Suspension", O. Schwarz and H. Merten, Brennstof-Warme-Kraft, vol. 18, No. 10, pp. 474–478, 1966.

*Primary Examiner*—Mark Rosenbaum

*Attorney, Agent, or Firm*—Brumbaugh, Graves, Donohue & Raymond

[57] ABSTRACT

In order to enable a reduction of the percentage of liquid in a liquid/coal pumping mixture the coal is dry-ground in a first grinding stage (1) to provide a relatively coarse particle size and then a fraction of the coarse ground coal is then dry-ground in a second grinding stage (9) to a relative fine particle size. The fine ground fraction is then mixed with the remainder of the coarse-ground fraction (7) and with the liquid.

4 Claims, 2 Drawing Figures

METHOD OF MANUFACTURING A PUMPABLE COAL/LIQUID MIXTURE

The invention relates to a method of manufacturing a pumpable coal/liquid mixture, in which the liquid preferably is water, but may also be fuel oil or methanol.

To obtain safe and cheap transport and storing of coal it is known (e.g. from R. S. Scheffee and E. T. McHale: "Development and Evaluation of Highly-Loaded Coal Slurries", 2nd International Symposium On Coal-Oil-Mixture Combustion, Nov. 27–29, 1979, Danvers, Mass., U.S.A. and Schwarz: "Herstellung, Transport Und Verbrennung Von Kohle/Wasser-Suspension", Brennstof-Warme-Kraft, Vol. 18, No. 10, page 474–478, 1966) to manufacture coal/liquid mixtures which are capable of being pumped through pipelines and burnt in e.g. boiler plants without previous dewatering or drying.

To achieve satisfactory combustion the coal for coal/liquid mixtures of the kind in question must be ground to a particle size not larger than about 0.2 mm. In coal/water mixtures this will often have the effect that the water content is high, approximately 50% or more, and thus the coal content correspondingly low, in which case the caloric loss when drying away the water during the combustion consquently increases correspondingly. When producing coal/oil and coal/methanol mixtures the highest possible coal content is preferred to replace as large as possible fraction of the oil or methanol by coal.

By grinding part of the coal to a considerably higher degree of fineness, the coal particles can be more closely packed because the small particles can fit into the cavities between the large particles resulting in a significant reduction of the liquid content in a pumpable coal/liquid mixture.

As the specific energy consumption of wet grinding is generally considered to be approximately 25 percent smaller than that of dry grinding it has previously been obvious to use wet grinding of coal when making coal/water mixtures, starting off with coal having 5–10% water and ending up with a mixture containing 35–40% water. This type of grinding of part of the coal to a high degree of fineness involves, however, a large energy consumption. It is known, e.g. from grinding of cement clinker, that the energy consumption can be reduced by using a tube mill with small grinding bodies for the fine-grinding, but the advantage thereof when wet-grinding coal is offset by the fact that small grinding bodies have a large specific surface, which causes strongly increased wear and corrosion, which is also intensified by the fact that coal is often sulphurous and consequently particularly strongly corrosive when mixed with water.

According to the invention in a method of manufacturing a coal/liquid mixture the coal is dry-ground to a relatively coarse particle size in a first grinding stage, and then a fraction of the coal from this first stage is then dry ground in a second grinding stage to a relatively fine particle size, after which the fine-ground fraction is mixed with the coarse-ground fraction remaining from the first grinding stage and with the liquid.

Preferably, the second grinding stage is carried out in a tube mill.

The amount of fine-ground coal to be admixed to to the coarse-ground amount of coal should preferably correspond closely to the free volume between the particles in the coarser fraction, and will depend upon the particular size distribution in this fraction.

Experience has shown that the closest packing is obtained when the fine fraction constitutes 25–50% of the mixture and when the average particle size of the fine fraction ranges from approximately $\frac{1}{3}$ to approximately 1/15 of the average particle size of the coarse fraction.

Significant advantages are obtained by the method when fine-grinding in a tube mill. The consumption of grinding bodies in such a mill when dry-grinding is only approximately 1/10 of the consumption when wet-grinding and by appropriate planning of this dry-grinding it has been possible to reduce the specific energy consumption by 40% as compared with wet-grinding. Such an advantageous grinding economy when dry-grinding is achieved by using particularly small grinding bodies for the very energy consuming fine-grinding.

It has turned out that a particle size distribution particularly advantageous in case of low liquid content is obtained when the coal ground in the first grinding state is divided, e.g. by means of a separator, into a coarse fraction and a fine fraction and the fine fraction is passed to the second grinding stage.

Of the mill types known up to now tube mills are, as indicated above, the ones most suited for the fine-grinding, and the aforementioned separation makes possible a fine-grinding in a tube mill with grinding bodies having an average weight of not more than 5 grams, which results in a particularly fine grinding economy.

The use of such small grinding boides for fine-grinding is particularly advantageous in case of dry-grinding, as the small grinding bodies, when grinding coal suspended in a liquid with high viscosity, such as oil, also are suspended in the suspension with the result that the grinding efficiency becomes poor.

It has furthermore turned out that dry-grinding of coal for the desired coal/liquid mixture causes an approximately 4 percent lower liquid content in the mixture than in the case of wet-grinding, which is believed to be due to the fact that the dry-grinding in a tube mill with small grinding bodies provides a more advantageous particle size distribution for closer packing of the coal particles.

The grinding in the above first grinding stage may take place in a separate tube mill or in a first grinding chamber in a multi-compartment tube mill.

A vertical roller mill is, however, particularly advantageous for the coarser grinding in the first stage, as a roller mill has the advantage compared with a tube mill that its energy consumption is lower, and it is capable of grinding coal with a larger content of liquid and a larger lump size.

If a multi-compartment tube mill is used for the grinding, the fine-grinding may take place in the second chamber of the mill.

Finally, it should be noted that most kinds of materials being exposed to grinding often tend to agglomerate during fine-grinding which impedes the grinding, but such tendencies have not arisen when fine-grinding coal by means of small grinding bodies.

Two examples of plants for use in carrying the method of the invention will now be described with reference being made to the accompanying drawings in which.

Figure 1:
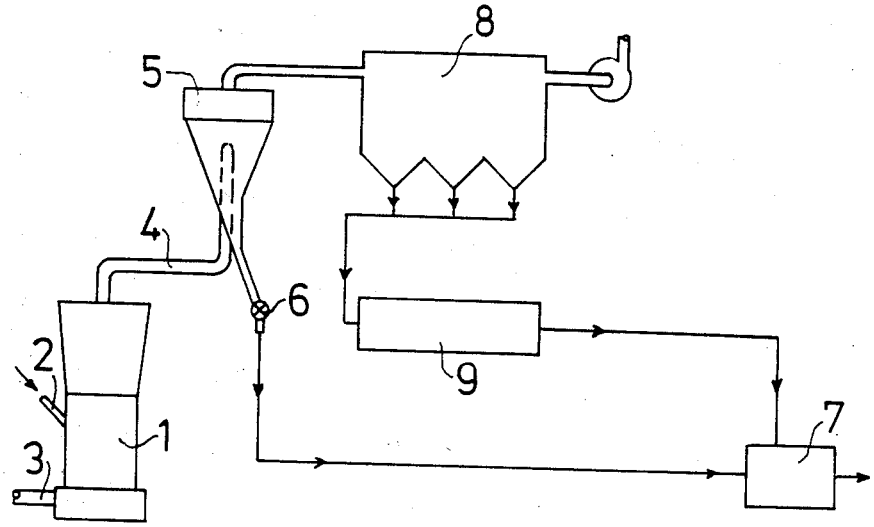
FIG. 1 shows diagrammatically a first embodiment of a plant.

In FIG. 1 a vertical roller mill 1 is shown which, as mentioned, is particularly suited to the task of coarse grinding i.e. because use of a roller mill ensures a narrow particle size interval. Coal to be ground is introduced into the mill through a material inlet 2. As raw coal often has a water content of 5–10 percent, drying of the coal must take place in connection with the grinding. Conveying and drying air are introduced into the mill through an air supply pipe 3, finished ground coal being discharged in known manner through the top of the mill suspended in the transport air after an internal separation in a built-in separator, not shown, in the mill, and further through an outlet pipe 4 to a separator 5 where the primarily ground coal is divided into a fine fraction and a coarse fraction.

The coarse fraction is passed from the separator 5 through a coarse fraction outlet 6 direct to a mixer 7.

The fine fraction is passed from the separator 5 to a filter 8 to be separated from the transport air, the fine fraction subsequently being conveyed to a tube mill 9 for fine-grinding, and from the tube mill further onto the mixer 7.

By utilziing only the fine fraction from the separator 5 for further grinding in the tube mill 9, it is possible to use very small grinding bodies in the tube mill, which, as previously mentioned, entails very advantageous grinding economy and an advantageous particle distribution in the finished product.

In the mixer 7, the coarse fraction is mixed with the finely ground coal fraction and with liquid to form the finished coal/liquid mixture.

Figure 2:
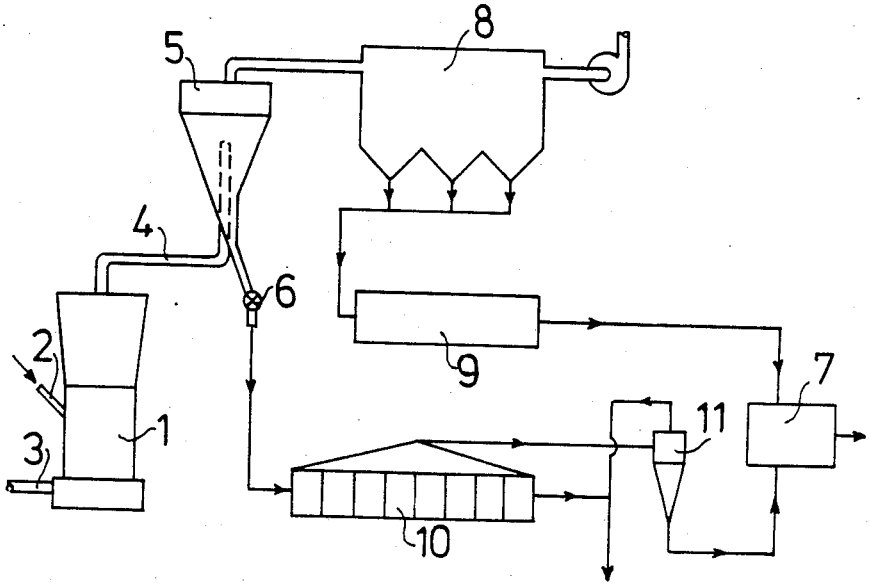
FIG. 2 shows a modified embodiment of the plant.

With a view to reducing the content of ash and sulphur in the finished mixture the coarse fraction from the separator 5 may possibly be cleaned before it is passed to the mixer 7. Such a cleaning can be performed by flotation, as indicated in FIG. 2, by means of a flotation tank 10, from which the flotation concentrate is passed to a hydrocyclone 11 to be dewatered, before being passed to the mixer 7.

I claim:

1. A method of manufacturing a pumpable coal/liquid mixture, said method comprising the steps of dry-grinding said coal to a relatively coarse particle size in a first grinding stage, separating said dry-ground coal into a coarser fraction and a finer fraction, thereafter dry-grinding said finer fraction in a tube mill, said tube mill having grinding bodies having an average weight of not more than 5 grams, to a relatively fine particle size thereby forming a fine-ground fraction, and thereafter mixing said fine-ground fraction and said coarser fraction remaining, without further grinding, from said first grinding stage together with a liquid so as to form a pumpable slurry consisting essentially of said fine-ground fraction, said coarser fraction and said liquid.

2. A method according to claim 1, wherein said first grinding stage is carried out in a vertical roller mill.

3. A method according to claim 1 wherein the liquid is at least one of the group consisting of water, oil or methanol.

4. A method according to claim 1 wherein the size of the coarse-ground fraction relative to the fine-ground fraction is adjusted such that the volume of the fine-ground fraction substantially corresponds to the free volume between the particles of the coarse-ground fraction.

* * * * *